US011814823B2

(12) United States Patent
Garcia

(10) Patent No.: US 11,814,823 B2
(45) Date of Patent: Nov. 14, 2023

(54) MONITORING APPARATUS FOR HYDRANT

(71) Applicant: AMI Investments, LLC, Carrollton, TX (US)

(72) Inventor: John Garcia, Rowlett, TX (US)

(73) Assignee: McWane, Inc., Birmingham, AL (US)

( * ) Notice: Subject to any disclaimer, the term of this patent is extended or adjusted under 35 U.S.C. 154(b) by 0 days.

(21) Appl. No.: 18/189,560

(22) Filed: Mar. 24, 2023

(65) Prior Publication Data

US 2023/0228069 A1 Jul. 20, 2023

Related U.S. Application Data

(63) Continuation of application No. 17/489,531, filed on Sep. 29, 2021, now Pat. No. 11,613,877.

(60) Provisional application No. 63/086,192, filed on Oct. 1, 2020.

(51) Int. Cl.
*E03B 9/04* (2006.01)
*E03B 7/07* (2006.01)

(52) U.S. Cl.
CPC . *E03B 9/04* (2013.01); *E03B 7/07* (2013.01)

(58) Field of Classification Search
CPC ..... E03B 9/04; E03B 9/06
See application file for complete search history.

(56) References Cited

U.S. PATENT DOCUMENTS

| | | | | |
|---|---|---|---|---|
| 6,816,072 | B2 * | 11/2004 | Zoratti | E03B 9/04 137/272 |
| 2003/0107485 | A1 * | 6/2003 | Zoratti | A62C 31/28 340/568.1 |
| 2012/0004866 | A1 * | 1/2012 | Plouffe | E03B 9/02 702/50 |
| 2020/0384296 | A1 * | 12/2020 | Sitnikov | A62C 35/20 |
| 2020/0385960 | A1 * | 12/2020 | Sitnikov | E03B 9/02 |
| 2020/0385961 | A1 * | 12/2020 | Sitnikov | G01L 19/086 |

* cited by examiner

*Primary Examiner* — Reinaldo Sanchez-Medina
(74) *Attorney, Agent, or Firm* — Maynard Nexsen PC; Brian T. Sattizahn

(57) ABSTRACT

Apparatuses for a hydrant, as well as associated methods for installing the same, may be directed to a threaded stem for actuating a hydrant outlet valve at a first end of the stem. An attachment nut may define a bore for supporting the stem in the hydrant. The attachment nut defines a cavity configured to receive water from a barrel of the hydrant. The attachment nut also defines a water access passage extending through an outer wall of the attachment nut to the cavity. The apparatus also includes a sensor in fluid communication with the cavity to obtain sensor data for the water in the barrel.

20 Claims, 5 Drawing Sheets

100

112
118
120
129
110
116
108
114
102
106
104
106
106

MONITORING APPARATUS FOR HYDRANT

CROSS-REFERENCE TO RELATED APPLICATIONS

This application is a continuation of U.S. patent application Ser. No. 17/489,531, filed on Sep. 29, 2021 and granted as U.S. Pat. No. 11,613,877, which application claims priority to U.S. Provisional Patent Application No. 63/086,192, filed on Oct. 1, 2020, the entire contents of both applications are hereby expressly incorporated by reference in their entirety.

BACKGROUND

Water distribution systems provide water for commercial and residential use within a geographic area. The water is generally treated prior to distribution in order to ensure that it complies with legal, regulatory, and customer requirements relating to the quality and content of the distributed water. Water and other aspects of distribution systems therefore need to be monitored with respect to these requirements.

Known monitoring systems may employ sensors that are distributed throughout the system for measuring operating parameters of the system relating to customer and regulatory requirements. Sensors typically must be in contact with water supplied by the distribution system, and as such installation of sensors generally is labor-intensive and requires specialized systems or devices to allow sensors to be installed in locations where water system data can be collected.

SUMMARY OF THE INVENTION

In at least some example illustrations, an apparatus for a hydrant includes a threaded stem for actuating a hydrant outlet valve at a first end of the stem. The apparatus also includes an attachment nut defining a bore for supporting the stem in the hydrant. The attachment nut defines a cavity configured to receive water from a barrel of the hydrant. The attachment nut also defines a water access passage extending through an outer wall of the attachment nut to the cavity. The apparatus also includes a sensor in fluid communication with the cavity to obtain sensor data for the water in the barrel.

In at least some example approaches, an apparatus for a hydrant includes a threaded stem for actuating a hydrant outlet valve at a first end of the stem, and an attachment nut defining a bore for supporting the stem in the hydrant. The attachment nut defines a cavity configured to receive water from a barrel of the hydrant. The attachment nut also defines a water access passage extending through an outer wall of the attachment nut to the cavity. The apparatus also includes a sensor in fluid communication with the cavity to obtain sensor data for the water in the barrel, and a processor in communication with the sensor. The apparatus also includes a memory, a communication interface, and a stem enclosure secured to the attachment nut. The stem enclosure contains the sensor, the processor, the memory, and the communication interface. The memory includes instructions stored thereon that when executed by the processor cause the processor to receive the sensor data, determine one or more measurement values based on the sensor data, and transmit the one or more measurement values to an external monitoring system via the communication interface.

At least some example illustrations herein are directed to a method, which includes installing an attachment nut defining a bore into a hydrant. The method also includes inserting a threaded stem through the attachment nut into the hydrant, with the threaded stem being configured to actuate a hydrant outlet valve at a first end of the stem. The attachment nut defines a cavity configured to receive water from a barrel of the hydrant. The attachment nut also defines a water access passage extending through an outer wall of the attachment nut to the cavity.

BRIEF DESCRIPTION OF THE DRAWINGS

The above and other features of the present disclosure, its nature and various advantages will be more apparent upon consideration of the following detailed description, taken in conjunction with the accompanying drawings in which.

DETAILED DESCRIPTION

Example illustrations herein are generally directed to apparatuses, systems, and methods that allow relatively simplified installation of a sensor for collecting water system data to existing hydrants. In an example apparatus, a stem assembly for a hydrant allows a monitoring device or sensor access to water within a barrel of the hydrant. Accordingly, the stem assembly may facilitate communication of operating parameters associated with the water distribution system from a monitoring apparatus. Example illustrations herein may thus facilitate monitoring of one or more operating parameters, ex., water pressure or temperature, at different hydrant locations in a water distribution system, and communicating information about the operating parameters to a user device. Merely by way of example, sensors, monitoring devices, communications circuitry, systems, and methods for water distribution systems are disclosed in U.S. Pat. No. 10,317,384, filed Sep. 21, 2016 and entitled "Remote Monitoring of Water Distribution System," U.S. patent application Ser. No. 17/161,280, filed Jan. 28, 2021 and entitled "Post-Event Modification of Local Clock Values in Water Distribution System," and U.S. patent application Ser. No. 17/314,519, filed May 7, 2021 and entitled "Water Delivery Monitoring," and the disclosures of each are hereby incorporated by reference herein in their entireties.

At least some example approaches employ a stem assembly that facilitates retrofitting of a monitoring apparatus into a previously installed or existing hydrant. Accordingly, water distribution systems may add one or more sensors by installing an example apparatus into a hydrant. The sensors may be a pressure sensor, temperature sensor, or any other sensor that is convenient. Retrofitting of sensors into hydrants may be convenient in wet-barrel applications, i.e., where a quantity of water is contained within the barrel of the hydrant at all times, however this is not limiting and other approaches are possible. Accordingly, example apparatuses described further below generally include one or more sensors may be installed or retrofitted to a hydrant that is already deployed and operational in the field. In some approaches, a horizontal hydrant valve stem and its packing assembly may be replaced with an example apparatus.

Figure 1:
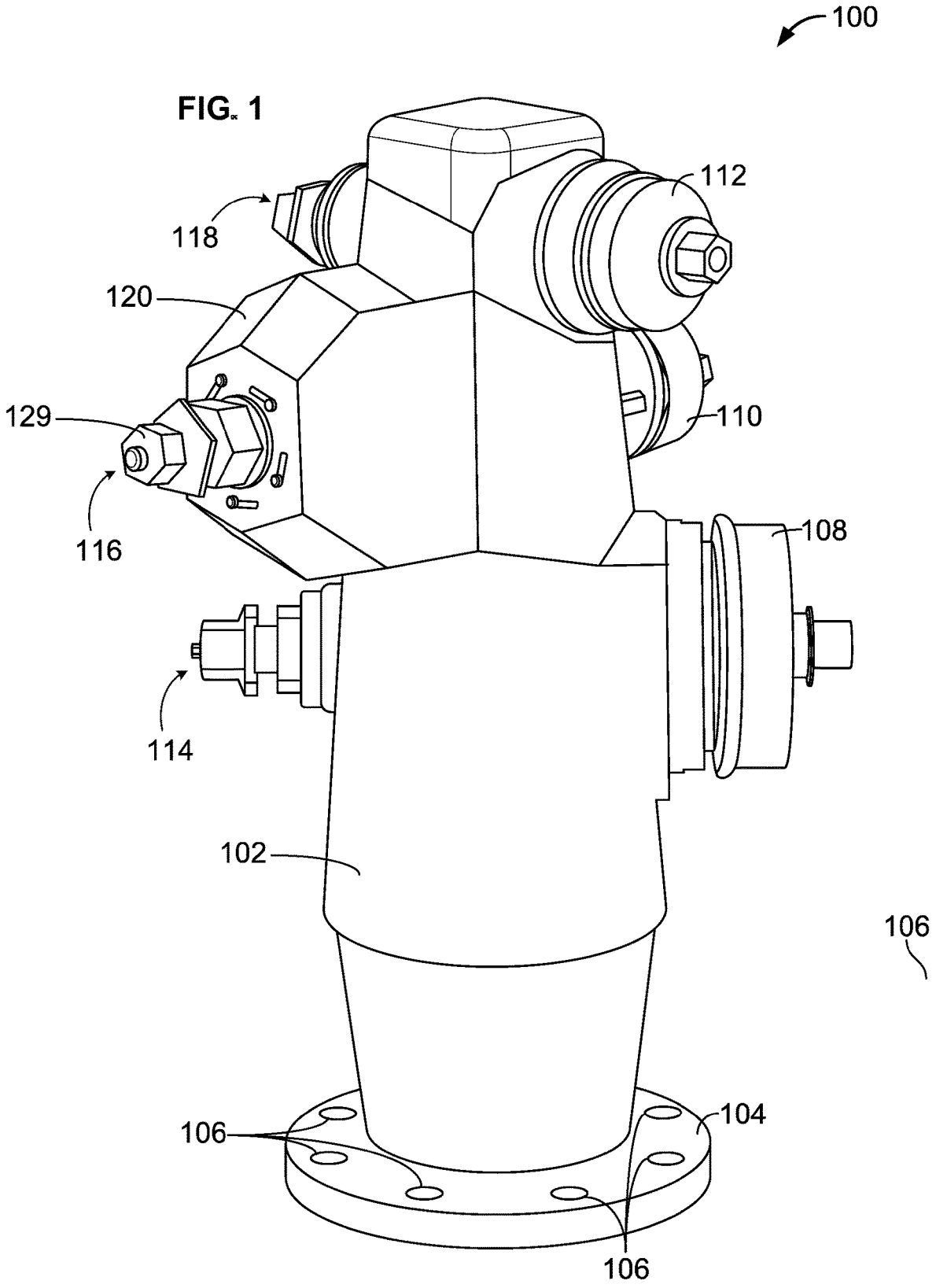
FIG. 1 shows an illustrative hydrant, in accordance with some embodiments of the present disclosure.

Referring now to FIG. 1, an example hydrant 100 is illustrated and described in further detail. The hydrant 100 includes a barrel 102 extending from a flange 104 configured to be secured to a water supply (not shown), e.g., via a plurality of through-holes 106. In an example, bolts or other threaded fasteners are positioned to extend through the holes 106, thereby clamping the flange 104 to the water supply. The hydrant 100 is illustrated as a wet-barrel hydrant, i.e., where water is generally contained within the barrel 100, as opposed to being controlled at a below-ground valve (e.g., a dry-barrel hydrant). The hydrant 100 may have any number of stems for supplying water from the barrel 102, e.g., to a fire hose. The example hydrant 100 is illustrated with three caps 108, 110, and 112 for respective stems 114, 116, and 118. A stem enclosure or cover 120 positioned at an operating end of the stem 116, i.e., at a same end of the stem 116 as operating nut 129, conceals an apparatus that allows for monitoring of water supplied to the hydrant 100. The cover 120 may be formed of a non-metallic material, such as a composite material, or may have portions that are non-metallic, to facilitate wireless communications between components sealed within the cover 120 and the external environment (e.g., a central monitoring system, monitoring application, etc.). The cover 120 also generally provides an enclosure for the stem 116 and, as seen in the example in FIG. 2, may be secured to the attachment nut 138, e.g., by way of one or more threaded fasteners 121. As depicted in FIG. 1, cover 120 and associated monitoring circuitry and components are located at a particular stem 116, and cover 120 is accordingly configured to attach and seal to an external surface of hydrant 100 in an unobtrusive manner. It will be understood that a cover and associated monitoring circuitry and components having appropriate covers 120 may be attached to other stem and external hydrant locations as may be suitable for particular hydrant designs.

Figure 2:
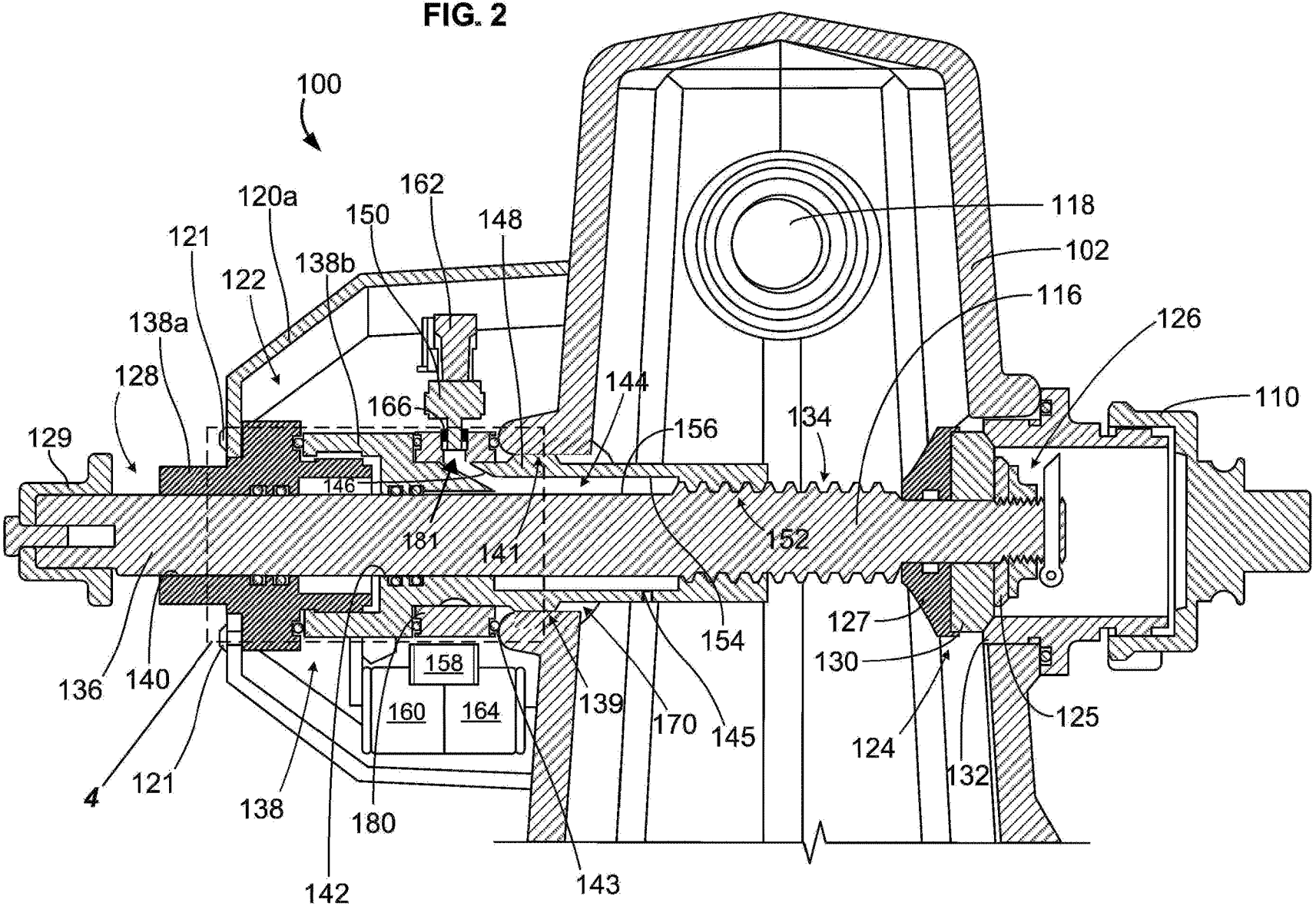
FIG. 2 shows an example monitoring apparatus for a hydrant, in accordance with some embodiments of the present disclosure.
Figure 3:
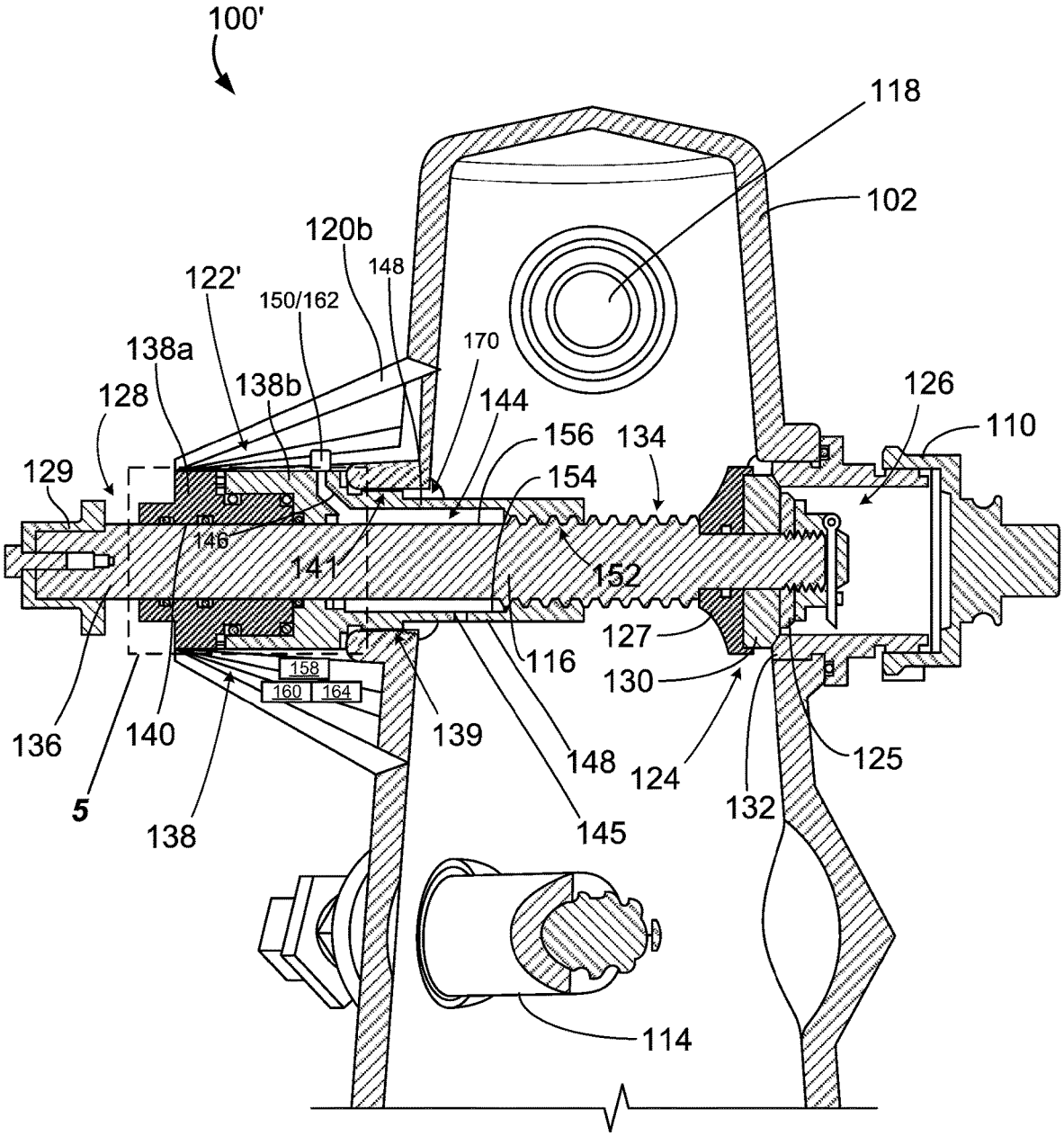
FIG. 3 shows another example monitoring apparatus for a hydrant, in accordance with some embodiments of the present disclosure.

Referring now to FIGS. 2 and 3, example apparatuses 122 and 122' are illustrated and described in further detail. Operation of the apparatuses 122 and 122' are similar inasmuch as they facilitate the installation or retrofitting of a sensor or other monitoring devices to a hydrant, and as such the description that follows applies similarly to each apparatus, with like reference numbers indicating like features. Differences between the two apparatuses 122 and 122' will be elaborated below, as well. For example, the external cover 120*a* of the apparatus 122 of FIG. 2 is shaped differently from a cover 120*b* of apparatus 122' shown in FIG. 3. Each of the covers 120*a* and 120*b* generally provide an enclosure that inhibits or prevents intrusion of contaminants, moisture, etc., while facilitating external communications such as with a central monitoring system or mobile application or device. Additionally, the apparatus 122 of FIG. 2 includes an adapter ring 180 which provides a sealing interface between the attachment nut 138 and hydrant 100, while the apparatus 122' of FIG. 3 does not include an adapter ring, and as such the attachment nut 138 seals directly against the hydrant 100. Further, as will also be elaborated below, the apparatus 122 and apparatus 122' include differently configured internal seals.

Referring collectively now to the apparatuses 122 and 122' illustrated in FIGS. 2 and 3, the stem 116 is configured to actuate a hydrant outlet valve 124 at a first end 126 of the stem 116. In the example illustrated, a second end 128 opposite the first end 126 is provided with an operating nut 129, which allows the stem 116 to be turned. The stem 116 includes a threaded portion 134 that is mated with corresponding threads, as will be discussed further below, and as such the stem 116 moves axially relative to the hydrant 100 when turned with the operating nut 129. The axial movement of the stem 116 may open or close the valve 124, depending on the direction of rotation. The valve 124 includes an upper plate 125, a lower plate 127, and a seal 130 for engaging a bore 132 of the barrel 102. When the stem 116 is positioned such that the seal 130 is clamped against the bore 132 by the upper plate 125, water from the barrel 102 is generally contained within the barrel 102. When the stem 116 is rotated such that the seal 130 becomes spaced away from the bore 132, water from the barrel 102 may be supplied to, for example, a hose connected to the barrel 102.

The example stem 116 includes a shank 136 spaced from the threaded portion 134. The threaded portion 134, as noted above, allows the stem 116 to move axially within the barrel 102 upon turning of the operating nut 129, thereby opening or closing the valve assembly 124 depending on the direction of rotation of the stem 116. More specifically, the threaded portion 134 of the stem 116 is threadingly engaged with an attachment nut 138 included in the apparatus 122. The attachment nut 138 may, as illustrated in FIGS. 2 and 3, define an internal thread 152 corresponding to the externally facing thread 134 of the stem 116. The internal thread 152 of the attachment nut 138 is positioned at an internal end of the attachment nut 138, which is positioned within the barrel 102 of the hydrant 100 when the attachment nut 138 is installed to the hydrant 100.

In the examples shown in FIGS. 2 and 3, the attachment nut 138 includes two separate components or elements, including an external component 138*a* and an internal component 138*b*. As will be described further below, in other examples the attachment nut 138 may be formed as a monolithic single piece. In the two-component example of FIGS. 2 and 3, the external component 138*a* defines an external bore 140, while the internal component 138*b* defines an internal bore 142. Each of the bores 140 and 142 support the stem 116 in the hydrant 100. The internal component 138*b* is fixed to a bore 170 of the barrel 102. Merely by way of example, the internal component 138*b* may have an externally facing thread 139 that mates with a corresponding internally facing thread 141 of the bore 170. Additionally, a seal 143 (shown in an uncompressed state in FIG. 2) may be compressed between opposing faces of the hydrant 100 and attachment nut 138 as the threaded engagement between the internal component 138*b* and bore 170 is tightened.

As noted above, the apparatuses 122 and 122' may facilitate installation of sensors or other devices for monitoring operating parameters of a water system, e.g., water pressure, temperature, or the like. In the examples illustrated in FIGS. 2 and 3, the attachment nut 138 defines a cavity 144 that is configured to receive water from the barrel 102. A water access passage 146 also defined by the attachment nut 138 may extend through an outer wall 148 of the attachment nut 138 to the cavity 144. Accordingly, water within the barrel 102 may be received within the cavity 144, thus providing an opportunity to monitor desired characteristics of the water, such as temperature, pressure, material content, chemical content, and the like. A sensor 150 may be in fluid communication with the cavity 144, thereby allowing sensor data to be obtained for the water in the barrel 102. The attachment nut 138 is shown defining a radially outer wall 154 of the cavity 144, while the stem 116 defines a radially inner wall 156 of the cavity 144. Water in the barrel may be admitted to the cavity 144 in any manner that is convenient. For example, a barrel passage 145 may extend through the radially outer wall 154 of the cavity. As another example, water may be admitted to the cavity 144 via a clearance between the threaded portion 134 of the stem 116 and the mating threads 152 of the attachment nut 138. In at least some examples, the cavity 144 receives water from the barrel 102 without any pressure changes, and as such water within the cavity 144 may have a same pressure as water within the barrel 102 (e.g., after at least a minimal time for water pressure to equalize within the hydrant barrel and cavity 144 after a change in pressure within the barrel). Accordingly, measurements of operating parameters of characteristics of the water (including, but not limited to, water pressure) by the sensor 150 are indicative of the same operating parameters of the water within the barrel 102. Furthermore, at least in examples where hydrant 100 is a wet barrel hydrant, the pressure, temperature, and other measurable parameters of the water within the barrel 102 may be indicative of the same parameters within a water system within which the hydrant 100 is incorporated.

As noted above, the apparatuses 122 and 122' may be retrofitted or installed to an existing hydrant, allowing the addition of monitoring devices, sensors, and the like to an existing hydrant. More specifically, the stem 116 may be installed as a replacement of an existing or standard stem (not shown) of the hydrant 100. The example wet barrel hydrant 100 includes three stems 114, 116, and 118. In the example illustrated (as best seen in FIG. 1), installers of apparatus 122 may choose to replace the middle stem 116 (i.e., not the top hydrant stem 118), because the external weather-guard or cover 120 to be added around the replaced stem will rise above the stem along the body of the hydrant 100, and the top hydrant stem 118 may not have sufficient hydrant body above that top stem to allow for a snugly fitted stem enclosure, e.g., a weather-guard or cover 120. The stem enclosure or cover 120 may be formed of a non-metallic material, e.g., a composite material.

To retrofit an example apparatus 122 or 122' to the hydrant 100, initially a water supply to the hydrant 100 may be shut off, and water drained from the barrel 102, e.g., by way of releasing a lower stem of the hydrant 100, e.g., stem 114. An existing stem (not shown) may then be removed from the hydrant 100. For example, as noted above the bore 170 of hydrant 100 may be threaded, and as such the stem (not shown) may be unthreaded from the bore 170. The stem 116, attachment nut 138, and apparatus 122 may then be installed to the hydrant 100. The attachment nut 138 may be secured to the hydrant 100, e.g., by engaging an external thread(s) of the attachment nut 138 with a corresponding inwardly facing thread(s) of bore 170. The stem 116 may then be inserted into the attachment nut 138, with the two components being engaged by way of the threads 134, 152. It should be noted that a nozzle end of the stem 116, i.e., first end 126, may be unchanged relative to the hydrant 100 prior to installation/retrofitting of the apparatuses 122/122', and as such components of the first end 126, e.g., upper plate 125, lower plate 127, and seal 130, may simply be removed from the old stem and re-attached to the new stem 116 prior to insertion of the stem 116 into the attachment nut 138 and/or bore 170 of the hydrant.

The newly installed stem 116 may have a relatively longer axial length than the previous stem of the hydrant to allow installation of the attachment nut 138, sensor 150, etc. Accordingly, the stem 116 may extend further out from the face of the hydrant 100 on the operating nut side (i.e., left of the hydrant in FIG. 2/3) than the old stem to provide the space to accommodate the additional component(s). The non-metallic weather-guard or cover 120 may therefore conveniently shield the electronics inside it from the external environment, weather, etc. The new stem 116 may be longer than the old stem as noted above to accommodate the attachment nut 138 or other packing assembly, into which new functionality has been added, e.g., to allow provision of sensor(s) 150 and access to water within the barrel 102 of the hydrant 100. Example features of the attachment nut 138 are described further below.

In at least some examples, e.g., as illustrated in FIGS. 2 and 3, the radially inwardly facing thread 152 of the internal component **138*b* is not watertight against the corresponding thread 134 of the stem 116. Accordingly, water from the barrel 102 may be admitted to the cavity 144 as the stem 116 travels horizontally through the attachment nut 138 (either forward to close the valve seal or backward to open the valve seal). Additionally, the location of the opening "stop," i.e., where the upper valve plate 127 backs up into and thereby contacts the packing assembly/attachment nut 138 when the stem 116 is retracted to its fully open position, need not be different from the standard packing assembly of the hydrant 100. Accordingly, the operation of the stem 116 and therefore of the hydrant 100 may be unaffected by the addition of an example apparatus 122. For example, no additional turns of the stem 116 would be required to open the valve 124. All of the additional functionality provided by the added apparatus 122 (e.g., as a packing assembly including the attachment nut 138), where it now extends beyond the outer face of the hydrant 100**, further than did the old/standard stem and packing assembly.

In examples of an extended packing assembly such as apparatuses 122/122', the internal cavity 144, which may generally function as an internal reservoir or galley, is provided as a circumferential cavity inside the attachment nut 138 and around at least a portion of the stem 116 circumferentially, but axially spaced further back from the clearance between the female thread 152 and the corresponding thread 134 of the stem 116. And, the cavity 144 will generally be filled with pressurized water from inside the hydrant 100, e.g., from the barrel 102, regardless of an open/closed position of the valve 124. The presence of this cavity 144 may generally allow the pressurized water from inside the hydrant to reach the sensor 150 and associated electronics, which may be located on the outside of the hydrant 100, as will be discussed further below. In cases where the interaction between the thread 134 of the stem 116 is too tight against the radially outwardly facing thread 152 of the attachment nut 138 to allow for easy water flow along the threads 134/152, it may be necessary to provide a water access passage 145. Merely by way of example, one or more holes may be drilled through the body of the attachment nut/packing assembly, e.g., through the radially outer wall 154 of the internal component **138*b*. In this manner, the passage 145 remains within the barrel 102 of the hydrant 100, axially spaced from the female thread 152 of the attachment nut 138, thereby ensuring that water from inside the hydrant 100 can flow unimpeded into the cavity 144**.

The attachment nut 138 of the apparatuses 122/122' may be formed of any material that is convenient. In one example, the attachment nut 138, including both the external component 138*a* and internal component 138*b*, are formed of brass. Other materials may be employed for the external components 138*a* and/or internal component 138*b*. The attachment nut 138 may be screwed into the hydrant body (usually ductile iron) and wrenched into place with a large nut, with the attachment nut 138 sealing along sealing surface(s) thereof with one or more seals, e.g., O-ring(s), onto a machined face of the hydrant opening. Given unit to unit threading variations, it may be difficult to reliably predict the rotational alignment of the stem and packing nut assembly (and it is generally not critical to do so). The sensor package and/or other electronics of the apparatus 122 may be mounted after the new attachment nut 138 and stem 116 have been installed.

As noted above, the apparatus 122 of FIG. 2 differs from the example illustrated in FIG. 3 by the addition of adapter ring 180. In such examples, the adapter ring 180 may be fitted to the internal component 138*b*/attachment nut 138 prior to installation to the hydrant 100. The adapter ring 180 may be rotatable with respect to the attachment nut 138, at least until the attachment nut 138 is fully tightened to the hydrant 100, thereby allowing a rotational position of the sensor 150 and/or associate electronics relative to the attachment nut 138 to be changed. This may be convenient because the indexed or clocked positioning of the attachment nut 138 once installed to the hydrant 100 can vary, to the extent the attachment nut 138 is secured to the hydrant 100 via a threaded engagement to the bore 170. The adapter ring 180 may be mounted onto and around the attachment nut 138/stem 116 to allow water from the cavity 144. The water may flow from the cavity 144 into a circumferential hollow 181 of the adapter ring 180. The sensor 150 can be threaded and/or sealed to the adapter ring 180, such that water from the cavity 144, which flows to the circumferential hollow 181, contacts the sensor 150 for collection of operating parameter data such as water pressure, temperature, etc. As noted above, one or multiple angled channels or water access passages 146 may be provided to allow water to flow freely from the cavity 144 into the adapter ring 180. A seal 166 may be provided about the sensor 150 to prevent egress of water contacting the sensor 150 out of the cavity 144, passage 146, etc.

Figure 4:
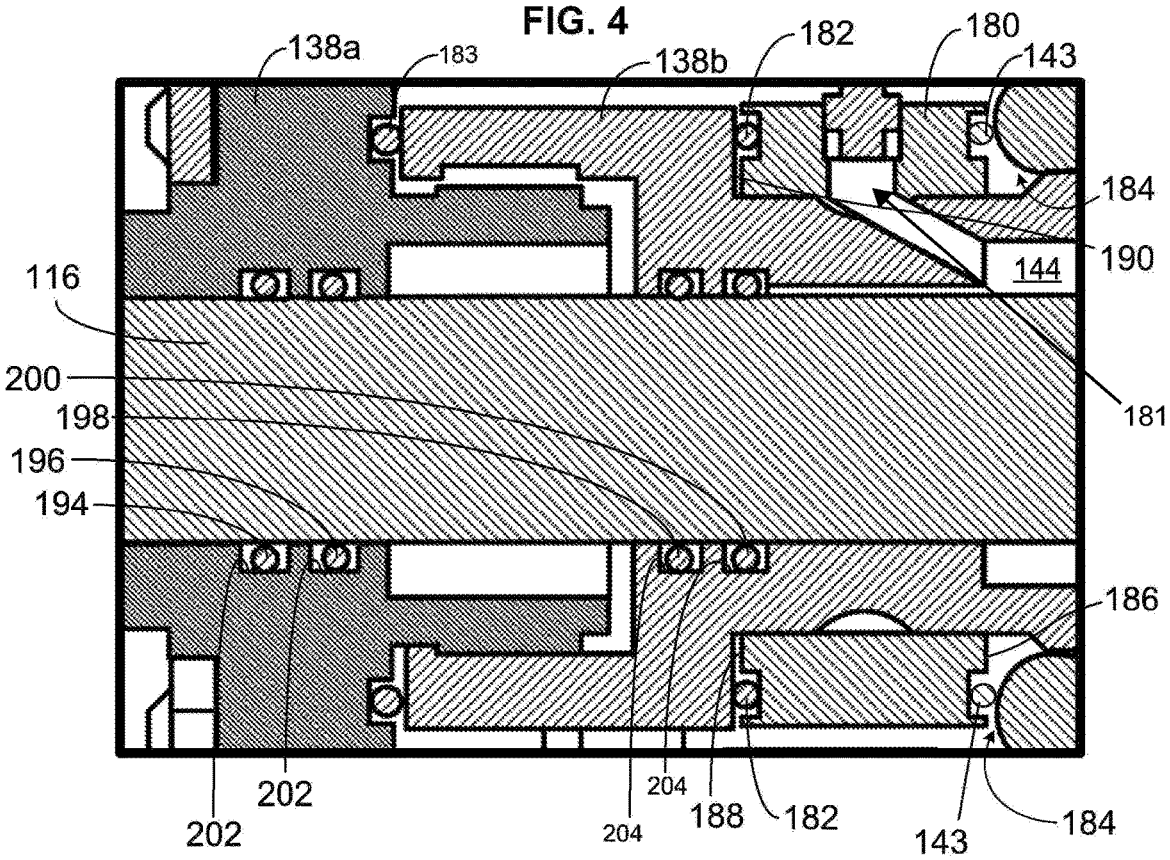
FIG. 4 shows an enlarged portion of the monitoring apparatus illustrated in FIG. 2, according to some example approaches.

As best seen in FIG. 4, the adapter ring 180 may have an outer face seal 182 that engages the internal component 138*b*. More specifically, the outer face seal 182 seals between an outer face 188 of the adapter ring 180, and an inner face 190 of the internal component 138*b*. On the opposite side of the adapter ring 180, the seal 143 may be disposed on an inner face 186 of the adapter ring 180, such that it engages a sealing surface 184 of the hydrant 100. An additional seal 183 may be positioned between the internal component 138*b* and external component 138*a*. The inner face seal 143, outer face seal 182 of the adapter ring 180, and the seal 183 may each generally prevent any water from leaving the adapter ring 180, except as that water flows back and forth to the cavity 144. Each of the seals 143, 182, and 183 may be provided as an O-ring shaped seal and may be formed of any material that is convenient, e.g., a silicone, rubber, or other compliant and/or water-resistant material.

The adapter ring 180 may have pins or notches (not shown) to fix its clocked or rotational position with respect to the hydrant 100, thereby inhibiting or preventing relative rotation within the bore 170 once installed. At the same time, the adapter ring 180 may allow for some slight variation in the orientation of the pressure sensor 150, e.g., by a lack of such clocking, notches, or the like between the adapter ring 180 and the attachment nut 138. In this way, the sensor(s) 150 can be roughly aligned into a specific orientation(s) with the adapter ring 180, e.g., at a top of the adapter ring 180, to facilitate fit within the cover 120.

As best seen in FIG. 4, apparatus 122 may have inner seals 194, 196, 198, and 200 provided between the attachment nut 138 and the stem 116. More specifically, the external component 138*a* includes inwardly facing circumferential channels 202, in which seals 194 and 196 are positioned. Additionally, the internal component 138*b* includes inwardly facing circumferential channels 204, which carry the seals 198 and 200. Each of the seals 194, 196, 198, and 200 generally provide a sliding seal with respect to the stem 116, i.e., preventing egress of water from cavity 144/passage 146.

Figure 5:
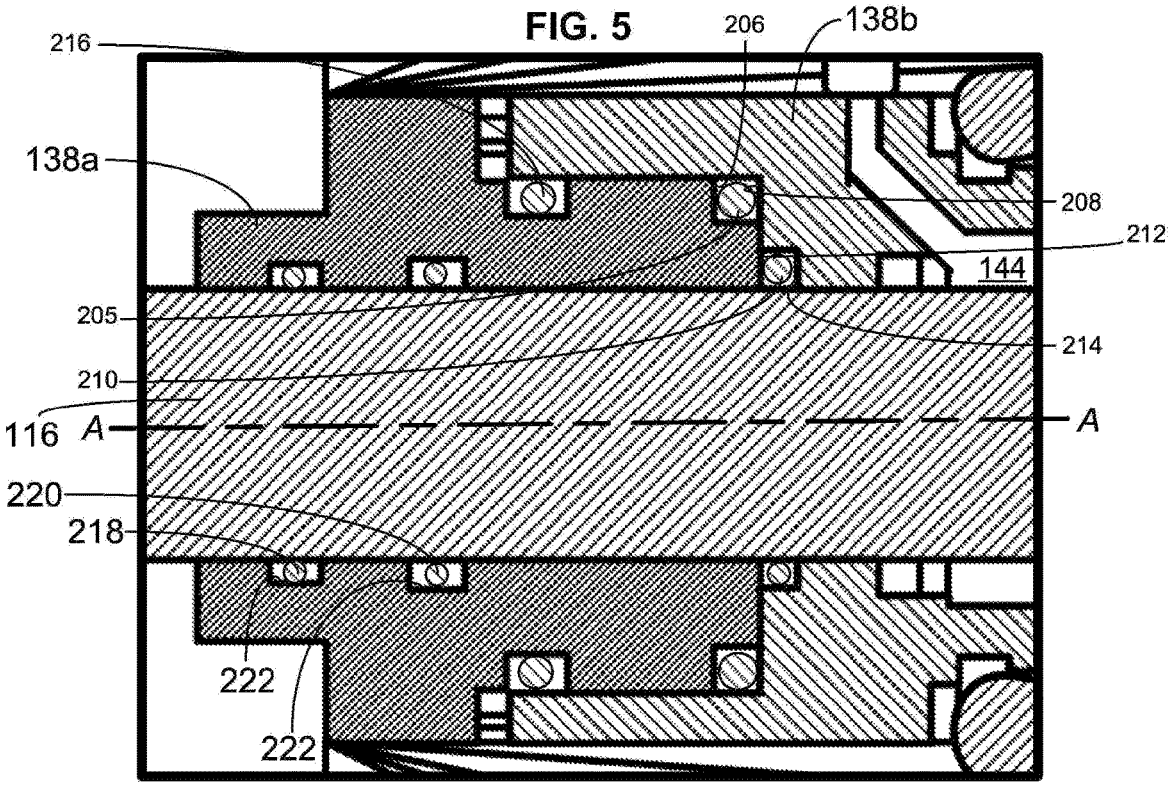
FIG. 5 shows an enlarged portion of the monitoring apparatus illustrated in FIG. 3, in accordance with some example embodiments.

Referring now to FIGS. 3 and 5, apparatus 122' is described in further detail, with particular reference to internal seals which are radially shifted with respect to each other. Accordingly, some example approaches may employ multiple seals and sealing surfaces between components of the apparatus 122', e.g., the stem 116 and/or attachment nut 138, with at least one of the seals/sealing surfaces being radially shifted from another with respect to an axis A-A of the stem 116 (see FIG. 5). More specifically, as best seen in FIG. 5, a seal 205 may be mounted or positioned between a first sealing surface 206 defined by the external component 138*a* and a second sealing surface 208 defined by the internal component 138*b*. An additional seal 210 may be mounted between a third sealing surface 212 defined by the external component 138*a* and a fourth sealing surface 214 defined by the internal component 138*b*. The seal 210 may be positioned in contact with the stem 116, while the seal 205 is radially shifted or spaced away from the stem 116 such that the seal 205 is further from the axis A-A than the seal 210. The first and second sealing surfaces 206, 208 may therefore be radially shifted from the third and fourth sealing surfaces 212, 214 with respect to the stem 116. Each of the seals 205, 210 may be provided as an O-ring shaped seal and may be formed of any material that is convenient, e.g., a silicone, rubber, or other compliant and/or water-resistant material.

The apparatus 122' may include seals and associated sealing surfaces in addition to the seals 205, 210 discussed above. For example, a seal 216 may be axially shifted from the seal 214 and may be radially compressed between the external component 138*a* and internal component 138*b* when installed. The seal 216 is also radially spaced away from the stem 116 in a manner similar to that described above regarding the seal 205. The apparatus 122' may also include one or more additional seals along the stem 116. For example, as best seen in FIG. 5, seals 218 and 220 may be positioned in radially inwardly facing circumferential channels 222 of the external component 138*a*. As with the other seals described above, the seals 216, 218, and 220 may be provided as an O-ring shaped seal and may be formed of any material that is convenient, e.g., a silicone, rubber, or other compliant and/or water-resistant material.

As noted above, each of the example apparatuses 122 and 122' include a sensor 150 for monitoring one or more operating parameters of water present in the hydrant 100. The apparatuses 122, 122' may include additional electronics for facilitating collection and/or communication of data relevant to the operating parameters, e.g., to a monitoring system or device. Merely by way of example, the apparatuses 122 and 122' may each include a power supply such as a battery 164, a communications interface 162 such as a wireless or cellular transceiver, a processor 158, and/or a computer-readable memory 160 communicatively linked with the processor. The memory 160 may include instructions stored thereon that when executed by the processor cause the processor to receive sensor data from the sensor 150, determine one or more measurement values based on the sensor data, and transmit the one or more measurement values to an external monitoring system via the communication interface 162. Memory, processing circuitry, communication circuitry, and additional electronics may be configured in a variety of manners, such as described in the incorporated U.S. Pat. No. 10,317,384, U.S. patent application Ser. No. 17/161,280, and U.S. patent application Ser. No. 17/314,519. As illustrated in apparatuses 122 and 122', it may be desirable to locate sensor(s) such as the sensor 150 in an upper area of the cover 120*a*/120*b*, above the stem 116, with the battery 164 located in a lower area below the stem 116. In such examples, the electronics may be positioned within the cover 120*a*/120*b* such that cellular and GPS/GNSS antennas of the communications interface 162 are attached to the upper half of the cover 120*a*/120*b*. The communication interface 162 may be communicatively linked with a monitoring system, e.g., via a cellular communication network.

It should be noted that the attachment nut 138 in the foregoing examples is provided in at least two main parts, i.e., the external component 138*a* and the internal component 138*b*. However, in other example approaches the attachment nut 138 may be formed as a monolithic single piece or, for that matter, in three or more components. Accordingly, the example illustrations herein are capable of such modifications. Merely as one example, the adapter ring 180 illustrated in FIG. 2 could be incorporated with the internal component 138*b* as a single piece.

Figure 6:
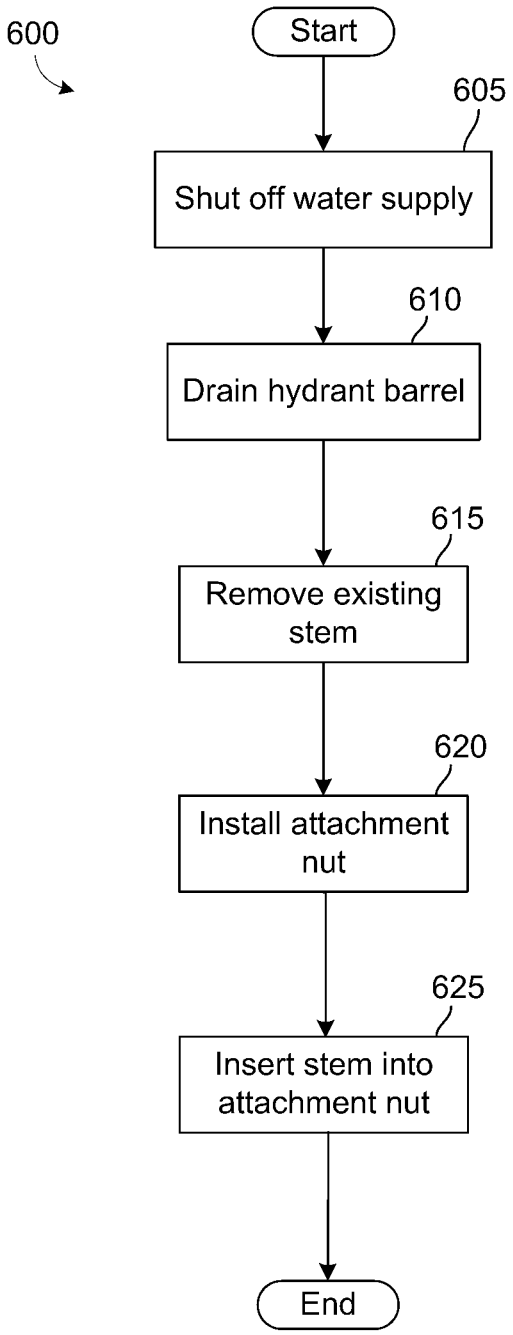
FIG. 6 illustrates a process flow diagram for an example method of installing a monitoring apparatus, according to some embodiments.

Proceeding to FIG. 6, an example process 600 for installing a monitoring apparatus, e.g., into a hydrant, is illustrated and described in further detail. In examples where an example apparatus is being retrofitted into an existing hydrant, process 600 may begin at blocks 605-615, where an existing stem and associated components are removed. More specifically, at block 605 a water supply associated with the hydrant may be turned off. Proceeding to block 610, a barrel of the hydrant may be drained, e.g., by opening one or more lower stems, drain valves, or the like of the hydrant. At block 615, an existing stem may be removed from the hydrant. Process 600 may then proceed to block 620.

At block 620, an attachment nut defining a bore may be installed into the hydrant. For example, as discussed above an attachment nut 138 may inserted into a bore 170 of hydrant 100 and secured by a threaded engagement between the bore 170 and the attachment nut 138. In at least some example approaches, the attachment nut 138 is provided in multiple separate components, e.g., an external component 138*a* and an internal component 138*b*.

Proceeding to block 625, a threaded stem may be inserted through the attachment nut into the hydrant. For example, as described above, a stem 116 may be inserted into the attachment nut 138, with radially outwardly facing thread(s) 134 engaging with radially inwardly facing thread(s) 152 of the attachment nut 138. A shank 136 of the stem 116 may be slidably supported within the attachment nut 138, with one or more seals between the shank 136 and the attachment nut 138, e.g., seals The threaded stem 116 may be configured to actuate a hydrant outlet valve 124 at an end of the stem 116, e.g., opposite an operating end 128 of the stem 116. Further, as also described above, the attachment nut 138 may define a cavity 144 configured to receive water from a barrel 102 of the hydrant 100. Additionally, the attachment nut 138 may define a water access passage 146 extending through an outer wall 148 of the attachment nut to the cavity 144. Accordingly, one or more sensor(s) may be installed to the attachment nut 138 and may thereby monitor operating parameter(s) of the hydrant and water system.

As described above in the various example illustrations, the example apparatuses 122, 122' and attachment nut 138, as well as process 600, may generally facilitate installation of sensors and electronics, e.g., at a hydrant, to facilitate collection of data associated with a water distribution system. For example, operating parameters such as water pressure or temperature may be monitored at various locations in the water distribution systems, e.g., across a number of hydrants, and communicated to a water system distributor or monitor. Sensor values may be compared with thresholds and/or used to provide alerts in response to detected variances from relevant threshold(s).

Additionally, in the example approaches herein water and parameter(s) thereof may generally be monitored outside a barrel of a hydrant. For example, in at least some approaches disclosed above, a channel or passage is created by which water is drawn from the barrel and monitored outside the body of a hydrant. Moreover, by allowing water to be drawn outside the barrel 102 for monitoring, other sensing/testing options are possible. Merely as one example, tests may be conducted on water drawn from the barrel with a reagent or other additive, which otherwise may be infeasible with respect to water that remains within the barrel (and thus part of the water supply). By contrast, upon completion of associated monitoring or testing, water drawn from the barrel to which the reagent has been added may be discarded or otherwise prevented from returning to the water supply in the barrel.

The foregoing is merely illustrative of the principles of this disclosure and various modifications may be made by those skilled in the art without departing from the scope of this disclosure. The embodiments described herein are provided for purposes of illustration and not of limitation. Thus, this disclosure is not limited to the explicitly disclosed systems, devices, apparatuses, components, and methods, and instead includes variations to and modifications thereof, which are within the spirit of the attached claims.

The systems, devices, apparatuses, components, and methods described herein may be modified or varied to optimize the systems, devices, apparatuses, components, and methods. Moreover, it will be understood that the systems, devices, apparatuses, components, and methods may have many applications such as monitoring of liquids other than water. The disclosed subject matter should not be limited to any single embodiment described herein, but rather should be construed according to the attached claims.

What is claimed is:

1. An apparatus of a hydrant, comprising:

a threaded stem for actuating a hydrant outlet valve at a first end of the stem;

an attachment nut defining a bore for supporting the stem in the hydrant, the attachment nut defining a cavity configured to receive water from a barrel of the hydrant, the attachment nut defining a water access passage extending through an outer wall of the attachment nut to the cavity to permit water from the barrel to enter the cavity; and a sensor located outside the barrel and in fluid communication with water in the cavity to obtain sensor data regarding the water in the barrel.

2. The apparatus of claim 1, wherein the attachment nut includes an external component located outside the barrel and an internal component at least partially located inside the barrel, one end of the internal component positioned adjacent to the first end of the stem.

3. The apparatus of claim 2, wherein the internal component is connected to an opening in the barrel.

4. The apparatus of claim 3, wherein the internal component has external facing threads that mates with internal facing threads of the opening in the barrel.

5. The apparatus of claim 2, wherein the bore comprises a first bore in the external component and a second bore in the internal component, the first and second bores each configured to support the stem.

6. The apparatus of claim 2, wherein the stem has a second end opposite the first end, the second end of the stem being located outside of the external component.

7. The apparatus of claim 1, wherein the attachment nut defines an internal thread corresponding to an external thread of the stem.

8. The apparatus of claim 7, wherein the internal thread is positioned at an internal end of the attachment nut positioned within the barrel of the hydrant when the attachment nut is installed to the hydrant.

9. The apparatus of claim 1, wherein the attachment nut defines a radially outer wall of the cavity, and the stem defines a radially inner wall of the cavity.

10. The apparatus of claim 1, further comprising:

a processor in communication with the sensor;

a memory; and a communication interface, wherein the memory includes instructions stored thereon that when executed by the processor cause the processor to receive the sensor data, determine one or more measurement values based on the sensor data, and transmit the one or more measurement values to an external monitoring system via the communication interface.

11. The apparatus of claim 10, wherein the communication interface is communicatively linked with a cellular communication network.

12. The apparatus of claim 10, further comprising a stem enclosure located outside the barrel and secured to the attachment nut, the stem enclosure containing the sensor, the processor, the memory, and the communication interface.

13. The apparatus of claim 12, further comprising a battery within the stem enclosure.

14. The apparatus of claim 1, wherein the attachment nut includes a passageway in fluid communication with the cavity.

15. The apparatus of claim 14, wherein the sensor is positioned on the attachment nut to access the water in the cavity via the passageway.

16. The apparatus of claim 14, further comprising an adapter ring positioned about the attachment nut, the adapter ring having a channel in fluid communication with the passageway.

17. The apparatus of claim 16, wherein the sensor comprises a pressure sensor partially located in the channel.

18. The apparatus of claim 17, further comprising a seal formed around a portion of the pressure sensor located in the channel.

19. An apparatus of a hydrant, comprising:

a threaded stem for actuating a hydrant outlet valve at a first end of the stem;

an attachment nut defining a bore for supporting the stem in the hydrant, the attachment nut defining a cavity configured to receive water from a barrel of the hydrant, the attachment nut defining a water access passage extending through an outer wall of the attachment nut to the cavity to permit water from the barrel to enter the cavity;

a sensor located outside the barrel and in fluid communication with the cavity to obtain sensor data for the water in the barrel;

a processor in communication with the sensor;

a memory;

a communication interface; and a stem enclosure located outside the barrel and secured to the attachment nut, the stem enclosure containing the sensor, the processor, the memory, and the communication interface, wherein the memory includes instructions stored thereon that when executed by the processor cause the processor to receive the sensor data, determine one or more measurement values based on the sensor data, and transmit the one or more measurement values to an external monitoring system via the communication interface.

20. A method, comprising:

installing an attachment nut defining a bore into a hydrant, wherein the attachment nut defines a cavity configured to receive water from a barrel of the hydrant, the attachment nut defining a water access passage extending through an outer wall of the attachment nut to the cavity to permit water from the barrel to enter the cavity;

inserting a threaded stem through the attachment nut into the hydrant, the threaded stem configured to actuate a hydrant outlet valve at a first end of the stem; and obtaining sensor data for the water in the barrel with a sensor located outside the barrel and in fluid communication with the cavity.

* * * * *